US005141136A

United States Patent [19]

Tignor

[11] Patent Number: 5,141,136

[45] Date of Patent: Aug. 25, 1992

[54] DUAL OPENING SQUEEZE BOTTLE

[76] Inventor: Jeffrey H. Tignor, 175 Blake Rd., Hamden, Conn. 06517

[21] Appl. No.: 645,728

[22] Filed: Jan. 25, 1991

[51] Int. Cl.[5] ..... B65D 37/00

[52] U.S. Cl. ..... 222/212; 222/478; 222/545; 215/1 C

[58] Field of Search ..... 222/206, 212, 213, 215, 222/540, 330, 331, 478, 481, 482, 107, 545; 215/1 R, 1 C

[56] References Cited

U.S. PATENT DOCUMENTS

| | | | |
|---|---|---|---|
| 676,012 | 6/1901 | Stafford | 222/107 |
| 2,543,163 | 2/1951 | Greiner | 222/481 |
| 2,673,011 | 3/1954 | Rood et al. | 222/215 X |
| 2,758,755 | 8/1956 | Schafler | 222/215 |
| 4,428,507 | 1/1984 | Sneider | 222/105 |
| 4,852,215 | 5/1989 | Le Blanc | 222/478 X |

FOREIGN PATENT DOCUMENTS

| | | | |
|---|---|---|---|
| 28057 | 4/1903 | Switzerland | 215/1 R |

*Primary Examiner*—Donald T. Hajec
*Attorney, Agent, or Firm*—Bachman & LaPointe

[57] ABSTRACT

A plastic container having a flexible side wall and contiguous flexible bottom wall with a recess in the bottom wall defining a rim portion encircling a depressed access opening whereby compression of the flexible side wall is operable to project the access opening outwardly.

3 Claims, 1 Drawing Sheet

DUAL OPENING SQUEEZE BOTTLE

BACKGROUND OF THE INVENTION

The present invention relates to containers and relates, in particular, to containers having a top and a bottom opening through which contained material can be introduced or dispensed.

In certain containers, particularly those fabricated of glass for containing relatively viscous materials, such as ketchup, mayonnaise, toothpaste, axle grease and the like, it is difficult to dispense materials of the above general class particularly when the containers are less than half full.

SUMMARY OF THE INVENTION

Therefore, it is a prime feature of the present invention to provide a container having top and bottom access openings where the structure of the container facilitates dispensing the contained materials conveniently and positively especially when the main body of the contained materials have been dispensed and residual material remains.

A further feature of the invention is the provision of a container fabricated of flexible plastic material whereby compression of the side walls of the container operates to dispense contained material through either access opening.

A still further feature of the invention is the provision of a flexible plastic container having at least two access openings where one opening is normally recessed within the body of the container.

A further feature of the invention is the provision of a flexible container side wall which is contiguous with a bottom wall defining a rim encircling a concavity said rim providing a support for said container and said concavity providing a recess for a container access opening.

A still further feature of the invention is the provision of a hollow container having a flexible plastic side wall and a contiguous, flexible bottom wall, defining a rim portion surrounding a recess, a first access opening including a first closure, a second access opening including a second closure normally positioned in said recess and within said rim portion of said bottom wall whereby compression of said flexible side wall when both said access openings are closed is effective to move said recessed bottom wall outwardly beyond said rim portion to facilitate removal of said second closure so that continued compression of said side wall when the second closure is removed is effective to extrude contained material from the interior of said container through said second access opening.

A method of forming a container operable to express or dispense residual portions of relatively viscous liquid materials such as ketchup, axle grease, toothpaste and the like embracing certain other principles of the invention may comprise the steps of providing a hollow plastic body having a continuous flexible side wall, providing a first or primary access opening including a closure means at one end of said body, folding a terminal margin of said side wall inwardly into said hollow body to form a bottom wall defining a cavity or recess surrounded by a rim portion, further forming said terminal margin to develop a continuous lip defining a second access opening within said cavity and within said rim, and providing a closure for said second opening whereby lateral pressure on the side wall of said body when both said openings are closed is operable to project said lip outwardly beyond said rim whereby said second opening becomes accessible for removal of its closure for dispensing said residual portions of said material upon application of further side wall pressure.

Other features and advantages of the present invention will become more apparent from examination of the succeeding specification when read in conjunction with the appended drawings in which:

BRIEF DESCRIPTION OF THE INVENTION

Figure 1:
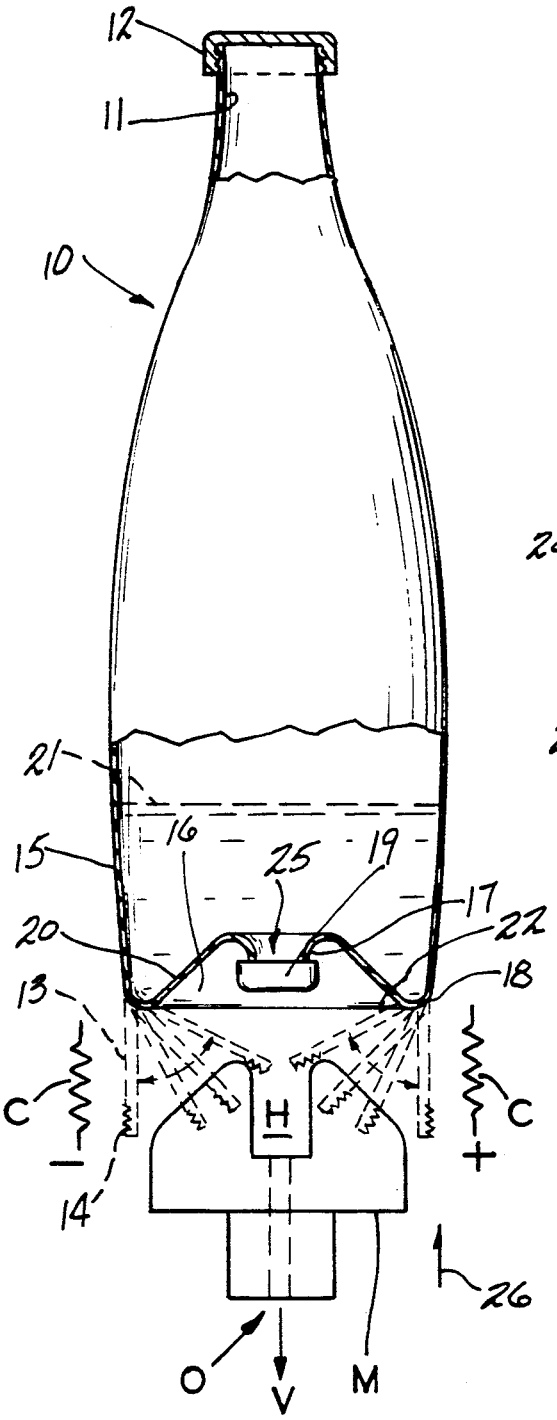
FIG. 1 is a vertical partial section of a flexible container showing the secondary opening in its normal position and showing the folding step for generating a cavity or recess in the bottom of the container.
Figure 2:
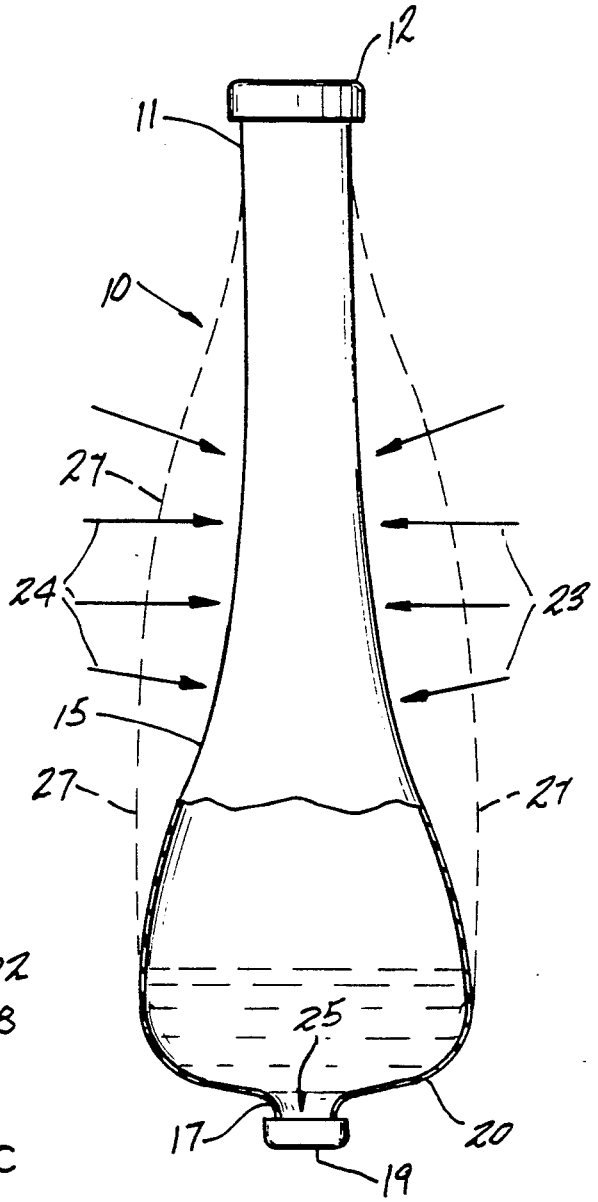
FIG. 2 shows the container of FIG. 1 with the secondary opening in distended or projected condition as a result of lateral pressure so that the container is poised for expressing residual materials from the container.

Referring to FIGS. 1 and 2 a container including a hollow, flexible, plastic body, indicated generally by the reference numeral 10, includes a first or primary access opening 11 with a removable closure means 12. A terminal or marginal extension 13 of side wall 15, indicated by the dashed lines, formed with threads at 14, is folded inwardly to define a bottom wall 20 in the form of a cavity or recess 16 surrounded by a rim portion 18. The bottom wall 20 is further formed with a continuous lip 17 defining a secondary opening 25 which is disposed within said cavity and is recessed relative to said rim portion 18. A closure means 19 is in threaded engagement with threads 14 formed on the margin 13.

The container, in the condition shown in solid lines in FIG. 1, is supported by the rim 18 so that the container is normally in an upright condition.

As stated previously, it is frequently difficult to remove residual portions of relatively viscous material from the ordinary glass container. Consequently, the principles of the present invention require that the container be fabricated of suitable flexible plastic materials such as polyethylene, polyvinyl chloride or other thermoplastic polymeric materials or mixtures thereof.

Obviously, depending upon the content of the container, the selection of the flexible plastic material must be consistent with the usual and customary packaging requirements. That is, when the container is originally filled with food stuffs, the plastic material must be of food grade.

When the container, indicated in solid lines in FIG. 1, has dispensed the main body of its contents through primary opening 11 with the bottom opening 17 remaining in its recessed condition, it becomes difficult to remove the residual material indicated by the dashed line 21 in FIG. 1.

That is, in a normal operation, the main body of contained material can be expressed from the primary access opening 11 by the application of lateral pressure as indicated by the arrows 23 and 24 without disturbing the recessed condition of secondary opening 25.

After an appreciable amount of material has been dispensed from the primary access opening, the residual material is removed in the following fashion.

The primary closure means 12 is connected to the primary opening 11 to form a closure. Thereafter, lateral pressure upon the side wall as indicated in FIG. 2 will cause bottom wall 20 and the secondary opening 25 to distend in that the cavity 16 dimples outwardly to the position shown in FIG. 2 whereupon the closure means 19 is accessible for removal.

Upon removal of the closure means 19 and with the primary opening closed, further application of pressure upon the side wall 15 is effective to extrude the residual material partially or in its entirety, as desired.

It is entirely within the contemplation of the invention that the container have sufficient elastic memory so that the side wall 15 will return to its original form as indicated by the dashed line 27 of FIG. 2 when the primary opening is vented to atmosphere.

In addition, upon venting the container, the secondary opening 25 and its closure 19 can be depressed manually (or by other suitable means) to return the bottom conformation of the container to its solid line position of FIG. 1.

This feature renders the container refillable and useful over and over again after appropriate cleansing.

Although the container is recyclable, the fact that it is reusable adds to its inventive merit.

In forming the bottom wall 20 and the recess 16, the margin 13 with molded threads 14 is softened by a suitable heating coil C.

Thereafter, the margin is turned inwardly manually or by a suitable forming tool to the dotted line position indicated by the reference numeral 22. Next, mold M is advanced in the direction of the arrow 26 to form the recess 16. During the shaping of the recess, and with the primary opening 11 closed, a vacuum V is applied at mold opening 0 effective to draw the lip 17 into the cylindrical hollow H of the mold.

After cooling, the solid line bottom configuration of FIG. 1 is established.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A flexible plastic container for packaging relatively viscous fluid materials including salve, mayonnaise, toothpaste, ketchup, and axle grease, a hollow body enclosed by a continuous flexible vertical wall, first and second openings at opposed ends of said body, a first removable cap means operable to close and seal said first opening, a second removable cap means operable to close and seal said second opening, said body having a bottom wall portion defining a rim means encircling a concavity defining a recess whereby said rim means provides a support for maintaining the container in an upright position, said bottom wall portion and said concavity being contiguous in seamless fashion with the vertical wall of the body, said vertical wall and said bottom wall being of uniform thickness, said second opening being recessed normally within said concavity whereby when both openings are closed and the container is compressed, the concavity is eliminated as the bottom wall portion projects outwardly beyond said rim means to deform said rim means and to provide access to said second cap means to facilitate removing said second cap means so that upon further compression substantially all fluid material is extruded from the container through said second opening.

2. The flexible container of claim 1 wherein the plastic is selected from the group consisting of polyvinyl chloride and polyethylene or mixtures thereof.

3. The flexible container of claim 1 wherein the first and second removable cap means are threadedly engaged with said first and second openings, respectively.

* * * * *